US009415261B2

(12) United States Patent
Wilson

(10) Patent No.: US 9,415,261 B2
(45) Date of Patent: Aug. 16, 2016

(54) ALL-IN-ONE TRAINING DEVICE, CARDIOVASCULAR AND STRENGTH TRAINING AND CONDITIONING APPARATUS

(71) Applicant: Anthony D Wilson, Riverside, IL (US)

(72) Inventor: Anthony D Wilson, Riverside, IL (US)

( * ) Notice: Subject to any disclaimer, the term of this patent is extended or adjusted under 35 U.S.C. 154(b) by 118 days.

(21) Appl. No.: 14/214,570

(22) Filed: Mar. 14, 2014

(65) Prior Publication Data

US 2014/0274610 A1 Sep. 18, 2014

Related U.S. Application Data

(60) Provisional application No. 61/783,421, filed on Mar. 14, 2013.

(51) Int. Cl.

| | |
|---|---|
| ***A63B 21/00*** | (2006.01) |
| ***A63B 23/12*** | (2006.01) |
| ***A63B 69/20*** | (2006.01) |
| ***A63B 21/02*** | (2006.01) |
| *A63B 23/00* | (2006.01) |

(52) U.S. Cl.

CPC ..... *A63B 23/1218* (2013.01); *A63B 21/025* (2013.01); *A63B 21/0628* (2015.10); *A63B 21/156* (2013.01); *A63B 21/4029* (2015.10); *A63B 21/4031* (2015.10); *A63B 21/4033* (2015.10); *A63B 69/201* (2013.01); *A63B 69/205* (2013.01); *A63B 2023/006* (2013.01); *A63B 2225/102* (2013.01)

(58) Field of Classification Search

CPC ..... A63B 211/00
USPC ..... 482/83, 84, 85, 86, 87, 88, 89, 90
See application file for complete search history.

(56) References Cited

U.S. PATENT DOCUMENTS

| | | | | | |
|---|---|---|---|---|---|
| 5,476,433 | A * | 12/1995 | Bruner | A63B 69/004 | 482/83 |
| 5,863,278 | A * | 1/1999 | Chen | A63B 69/20 | 482/83 |
| 6,220,992 | B1 * | 4/2001 | Shafik | A63B 69/20 | 482/104 |
| 6,348,028 | B1 * | 2/2002 | Cragg | A63B 69/201 | 434/248 |
| 7,658,699 | B1 * | 2/2010 | Johnson, Jr. | A63B 69/201 | 482/83 |
| 2006/0025285 | A1 * | 2/2006 | Giusti | A63B 69/201 | 482/83 |
| 2013/0059699 | A1 * | 3/2013 | Brenner | A63B 69/004 | 482/83 |
| 2015/0011365 | A1 * | 1/2015 | Nelson | A63B 69/205 | 482/84 |

* cited by examiner

*Primary Examiner* — Jerome W Donnelly
(74) *Attorney, Agent, or Firm* — John Marshall Law School Patent Clinic; Vargelis Economou

(57) ABSTRACT

An All-In-One Training Device, Cardiovascular and Strength training/conditioning apparatus for mixed martial arts, martial arts, cross fit, boxing, sports/athletic training, and rehabilitation therapies. The device is designed to efficiently combine cross training exercises of varying training methods to allow for training, conditioning, and strength training in a wide variety of sports, disciplines, and therapeutic uses without taking up a large amount of space.

20 Claims, 4 Drawing Sheets

ALL-IN-ONE TRAINING DEVICE, CARDIOVASCULAR AND STRENGTH TRAINING AND CONDITIONING APPARATUS

CROSS-REFERENCE TO RELATED APPLICATION

This is a nonprovisional application of a provisional application Ser. No. 61/783,421, filed on Mar. 14, 2013, which is incorporated by reference herein in its entirety.

FIELD OF THE INVENTION

The invention is generally related to devices or apparatuses for training. In particular, aspects of the invention is related to the areas of health/fitness (cross fitness, martial arts, boxing, and athletic/sports training) and rehabilitation (wounded veterans, Alzheimer patients, etc) as a circuit training and strength/condition tool that provides a combination of cardiovascular and strength benefits in one apparatus.

BACKGROUND

Fitness machines have been used by individuals to enhance their physiques, increase muscle strength, and improve overall health. At the same time, serious athletes that compete at professional or semi-professional levels also wish to use specialized training or fitness machines that tailor to their needs. This causes a concern whenever an individual moves from a casual fitness schedule to a more rigorous one: the less-intensive fitness machines need to be replaced because they can't adapt to the new routines of the individual. Current fitness machines or devices are designed as such so to encourage individuals to purchase new ones.

At the same time, existing fitness machines can't be used as a rehabilitation device due to the structure and limitations of existing fitness machines. Again, if an individual desires to have a rehabilitation device, one could not convert the existing fitness machine for that purpose.

SUMMARY OF THE INVENTION

Embodiments of the invention overcome the shortcomings of the prior technology by providing an efficient and versatile combination of fitness elements as an all-in-one fitness and rehabilitation device. In accordance with aspects of the present invention, as embodied and broadly described herein, one embodiment includes a heavy or training bag, a dip station, an abdominal station, a curl station, a triceps station, a row station, a speed bag, battle ropes of 30+ feet in length, and an adjustable bar for stretching and elevated push-ups. The base allows for the attachment of various pieces of equipment such as a double end speed bag in place of the heavy bag and for the attachment of an agility ladder of 30+ feet in length. The construction of the apparatus allows the user to do circuit training that involves both cardiovascular exercise/conditioning and strength training/conditioning in order to achieve an efficient total body workout. The workout is efficient because it allows circuit training without interruption, there is minimal rest time due to the lack of having to change equipment or use other pieces of equipment. The apparatus can function as a simultaneous workout station for multiple individuals. In one embodiment, the apparatus fits in a 3-4 ft by 5-6 ft area and takes up little space. The apparatus is 5-6 ft high, but can be adjusted based on the users preference and the height of their ceilings. In another example, the apparatus achieves this in a compact, attractive, and simplistic form factor.

In a further embodiment, the apparatus also has practical applications for rehabilitation/physical therapy as well.

BRIEF DESCRIPTION OF THE DRAWINGS

The accompanying drawings, which are incorporated in and form a part of the specification, illustrate the embodiments of the present invention and, together with the description, serve to explain the principles of the invention.

DETAILED DESCRIPTION OF THE PREFERRED EMBODIMENTS

Figure 1:
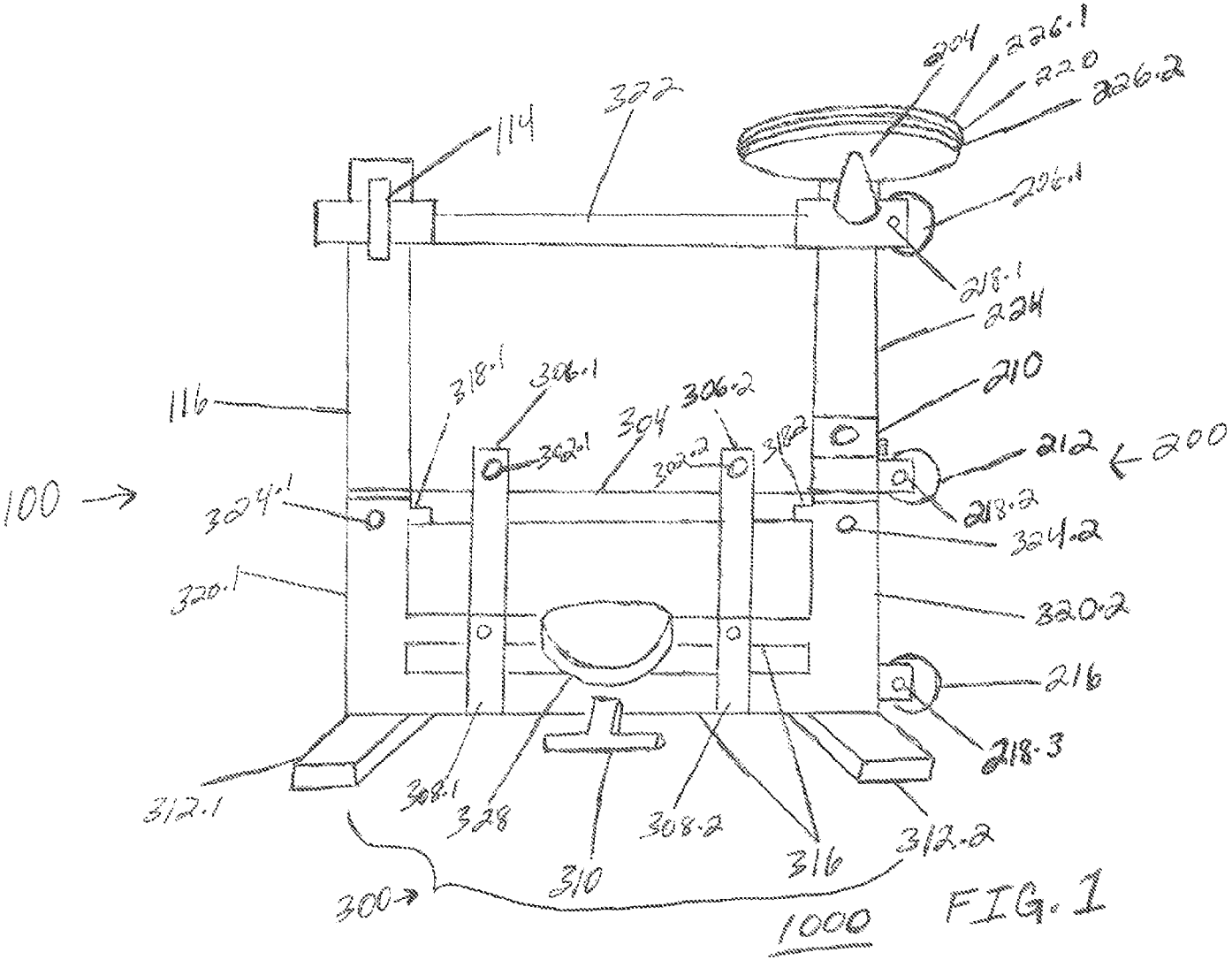
FIG. 1 is a frontal view of an apparatus according to one embodiment of the invention.

Referring to FIG. 1, a frontal view illustrates an apparatus 1000 according to one embodiment of the invention. The entire footprint for the apparatus is a width of four feet width, a depth of three feet, and height of six feet. The apparatus 1000 includes a base 300, a first tower 100, a second tower 200, and one or more exercise attachments. For example, the base 300 includes two vertical posts (e.g., first tower 100 and second tower 200) each having a footing 312.1 and 312.2. For the purposes of simplicity 0.1 and 0.2 will be added to figure numbers to delineate an element's location with regard to which is closer to the first tower 100 or the second tower 200. In this example, the two vertical posts are connected by support bars 304 and 316. For example, the supporting bars 304 and 316 may be one or more metal tubes measured 2"×2"×3' disposed perpendicular to the vertical posts 320.1 and 320.2. In another example, the support bars 304 and 316 may be diagonally connected to the two vertical posts 320.1 and 320.2. In a further example, the support bars 304 and 316 may be connected to the vertical posts 320.1 and 320.2 in a combination of horizontal or diagonal dispositions. According to this embodiment, the supporting bars 304 and 316 may be adjustable or fixed on the vertical posts 320.1 and 320.2. Moreover, the vertical posts 318.1 and 318.2 of the first tower 100 and second tower 200 further include notches to receive the supporting bars in different positions along the length of the vertical posts 318.1 and 318.2.

For example, one of the support bars 304 and 316 may be adjustable while the others may be permanently fixed to the vertical posts. The footing 312.1 and 312.2, in this example, may be 3 feet in length to maintain the stability of the base 100. It is to be understood that other lengths of the footing 312.1 and 312.2 may be used without departing from the scope and spirit of the invention. In this example each footing 312.1 and 312.2 extends 3 feet in front of the apparatus 1000's vertical receiving posts 320.1, 320.2 and 2 foot behind the vertical posts 320.1 and 320.2. In a further example, the footing 312.1 and 312.2 can have diagonal extensions of 1 or more inches at 1 or more degrees in any direction to aid in stability of the vertical posts 320.1 and 320.2. In another example, the footing 312.1 and 312.2 may be horizontal extensions, which extends 1 or more inches or feet in either direction to aid in stability of the vertical posts.

According to FIG. 1, the second set of dip posts may be attached to the support bars 304 and 316. In this example, the dip posts 306.1, 306.2 are vertical posts that attach to the bottom, horizontal, support bars between tower 100 and tower 200 by way of the receiving posts 308.1 and 308.2 of the base. In a further example, the vertical dip posts 306.1 and 306.2 may be connected to the horizontally or diagonally disposed support bars 304 and 316. In another example, dip bars 302.1 and 302.2 may be attached horizontally to the first tower 100, second tower 200, or the support bars 316 simultaneously or individually. According to this embodiment, the dip posts 306.1, 306.2 are adjustable in height and are 2"×2"×3'. In this example, the dip bars 302.1 and 302.2 are removable. In an alternative example, the dip bars 302.1 and 302.2 may be fixed. According to the embodiment of this invention, in this example, the vertical dip posts 306.1 and 306.2 may be secured to the support bars 304 and 316 with one removable bolt screw and weight pin per dip post 306.1 and 306.2. It is important to note that a wide variety of weight pins or bolt screws may be used to secure the dip posts.

In a further example, the dip posts 306.1, 306.2 may be welded to the receiving posts and not bolted to the device just as the first tower 100 and second tower 200 are attached to the base 300 of the device. Moreover, the dip posts 306.1, 306.2 include 0.5/8 inch holes or greater toward the distal end of the dip posts 306.1 and 306.2 to allow for height adjustability. In this example, the dip posts 306.1 and 306.2 have soft coated dip bars or handles 302.1, 302.2, about 6' in length, extending perpendicular to dip posts 306.1 and 306.2 from the top of the posts 306.1, 306.2. In another example, these handles 302.1 and 302.2 may or may not have a soft grip coating or may extend horizontally or vertically from the top of the posts 306.1 and 306.2. The posts may include varying handle shapes without substantially departing from the scope or spirit of the invention. In this example, the dip posts 306.1, 306.2 have 6 inch platforms extending from the front of the post

302.1 and 302.2. In operation, the apparatus 1000 allows a user to store/hang undulating ropes. In another example, the handles may not be present or be made in varying shapes, sizes, and lengths.

In this example, referring to FIG. 1, the bottom "T"-shaped bar 310, at the bottom midline of the first tower 100 and second tower 200, includes a flip down, removable handle extending from the bottom support bars 316. In operation, this T"-shaped bar 310 allows the user to hook their feet under it to do varying upper abdominal exercises or allows the user to grasp the "T"-shaped bar 310 and do a variety of lower and upper abdominal exercises. In the embodiment of this invention, the "T"-shaped bar 310 is rotatable and permanently attached to the bottom support bar between tower 100 and tower 200 by a flip down lever, approximately 12' in length. The "T"-shaped bar 310 is 12 inches in length. In another example, the flip down handle attachment may be removable and can include varying lengths and shapes of the handle and lever.

In this example, the horizontal, middle support bar 304 is adjustable and removable. The support bar 304 is a 2 inch bar of 3.5 feet in width. It may be used for a variety of exercises, including stretching exercise, seated dips, or elevated push up exercises. However, this is not meant to be an exhaustive list of its uses or application. In another example, the support bar 322 may be attached to the top of the apparatus 1000, between the first tower 100 and the second tower 200 as a pull up bar or TRX (suspended resistance training) bar 322 for various resistance exercises utilizing Olympic steady rings without departing from the scope or spirit of the device. This is not an exhaustive list of all the attachments that may be used with the invention.

In this example, the undulating/battling ropes (not shown) are supported in various lengths, weights, and materials. In this example the ropes of 30 feet in length, with a 2 inch diameter, can be secured around a rear post 326 of the apparatus 1000 (see FIGS. 3 and 4). In a further example, the ropes can be knotted or tied around the center of the bottom, the support bar 316, of the device. The support bar 316 acts as an anchor for the undulating/battling ropes during rope exercises. In another example, the undulating/battling ropes may be attached to the bottom of tower 100 or tower 200 without departing from the scope or spirit of the device. Additionally, the undulating/battling ropes may be attached to any part of the invention.

In another example, an agility ladder (not shown) may be attached to the support bar 304 and 316 in place of the undulating/battling ropes without departing from the scope or spirit of the device. The device supports agility ladders of various sizes, lengths, and weights for agility exercises. In this example, the agility ladder extends 15 feet in length from the front of the device. The base 300 acts as an anchor and prevents the agility rope from sliding during its use.

Figure 2:
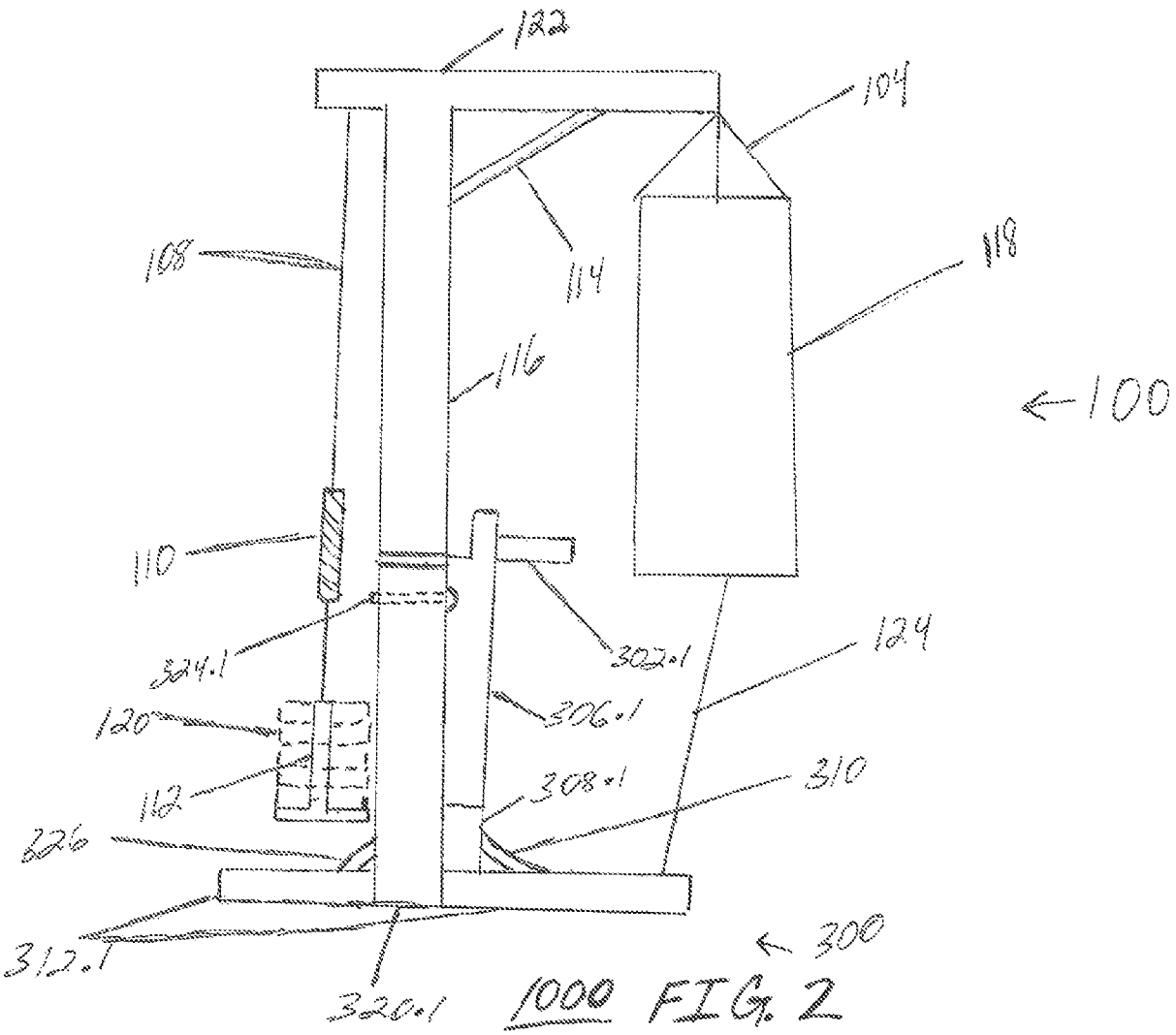
FIG. 2 is a side view of a first tower of the apparatus according to one embodiment of the invention.

Referring to FIG. 2, Tower 100 is a 6'×2 inch diameter, circular, steel tube that extends vertically from the first receiving post of 320.1. In this example, an L-shaped 2 inch, circular bar attaches perpendicular to the top of tower 100 and extends 2.5 feet from the front of the device and 1 foot behind the apparatus. In this example, a standard steel t-joint, as shown in 122, is used to join the top bar and the post of tower 100. In another example, 18-gauge, square, tubular steel pipes may be used by welding the pipes together. In other words, no joint is needed. In another example, a diagonal support strut 114, may be used between the horizontal bar extending from the front of the apparatus at tower 100 to add strength and integrity to the bar extending from the top of the first tower 100, for hanging a punching bag 118. However, various tube shapes, sizes, heights, weights, diameters, or supports that may be used without departing from the spirit of the invention, as this is not an exhaustive list.

Referring to FIG. 2, the distal end of the bar 122 extending horizontally from the top and front of the apparatus 1000 has a hanging unit which consists of a 4-inch i-bolt and dual swivel loop, as shown in 104, at the distal end, which may vary in length or diameter. In this embodiment of the invention, a dual swivel loop, is attached to the i-bolt 104 via an s-ring attached to the i-bolt. Further, attached to the dual swivel loop are two steel carabiner hooks. Each carabiner hook has a 6 inch chain attached to it. In this example, each chain has 7 links, with the middle link attaching to the end of the carabiner hook, leaving 3 links hanging from each side of the carabiner hook for a total of four hanging chains, to create the hanging unit, 104. In another example, chains but may include more or less links of varying lengths and diameter for various heights of hanging the punching bag without departing from the spirit of the invention.

Additionally, steel wire, nylon straps, or various hanging methods may be used without departing from the scope and spirit of the invention. Further, the end the hanging unit attaches to the D-rings of the punching bag, allowing it to hang from the tower 1. In another example, a stabilizing unit 124, including a 15 inch bungee cord, is attached to the distal end of smaller punching bags of 3-5' feet in height weighing 60-80 pounds via a carabiner hook attached to a dual swivel loop. The other end of the stabilizing unit attaches to footing 312.1 of the invention via a carabiner hook and dual swivel loop, attached to an i-bolt in the front footing 312.1 of the invention. The stabilizing unit attaches to the bottom of the punching bag via a d-ring to keep the punching bag in place.

In conjunction with the hanging unit, the stabilizing unit 124 allows a bag to turn about its axis, while staying in place, allowing a user to hit the punching bag without the need for a partner to hold the bag in place. In a further example, a chain or braided rope may be used in place of the bungee cord and may attach to the front footing 312.1 of the first tower 100 or body of the first tower 100 via a Velcro strap. However, this is not an exhaustive list of ways to attach the stabilizing unit to the device.

Referring to FIG. 2 counterweight 112 is attached to the distal end of the rear horizontal post of tower 100 to prevent the apparatus 1000 from tipping over under the weight of the punching bag and prevents the post 116 of tower 100 from breaking under the weight of the punching bag 118 by preventing stress on the horizontal, T-shaped bar 122 extending from the top of apparatus 1000. The counter weight has an 8 inch shock spring, 110, in the middle, welded in the center of the chain to absorb the shock on the invention from punching the punching bag. In this example, the counter weight consists of a 5.5 foot chain or steel wire connected to the distal end of the rear horizontal pipe, as shown in 108. In this example, the center of the counter weight consists of 10×10 lbs. Olympic weight plates, stacked on an 8 inch steel tube welded to flat square base of 6"×6" at its distal end. The top end of the tube has 3 carabiner hooks that attach to the 5.5 foot chain. The counterweight center tube base allows for weight plates of varying sizes, weights, and materials without departing from the spirit or scope of the invention, as this is not an exhaustive list of counter weights that may be used. The counterweight 112 is imperative to the structure of tower 100 because it counters the weight of the punching bag to prevent tower 100 from bending or becoming unstable. Balance is maintained between the weight of the punching bag 104 and the counterweight 112 in a 1:2 ratio. For example, this embodiment of the invention shows a 70 lbs. punching bag of 6' length with a counter-weight of 140 pounds. Varying weights and bags may be used, as this is not an exhaustive list of weight combinations, bags, or weights that may be used.

In another example, the t-shaped joint connection and counter-weight hanging chain may be replaced with an L-shaped 2 inch, square tubular bar, that allows for the counterweight to extend from the distal end of the bar via steel cable wire, attaching to the counter weight, with a shock absorbing spring in the middle without departing from the scope or spirit of this invention, as this is not an exhaustive list of counterweight attachments.

Figure 3:
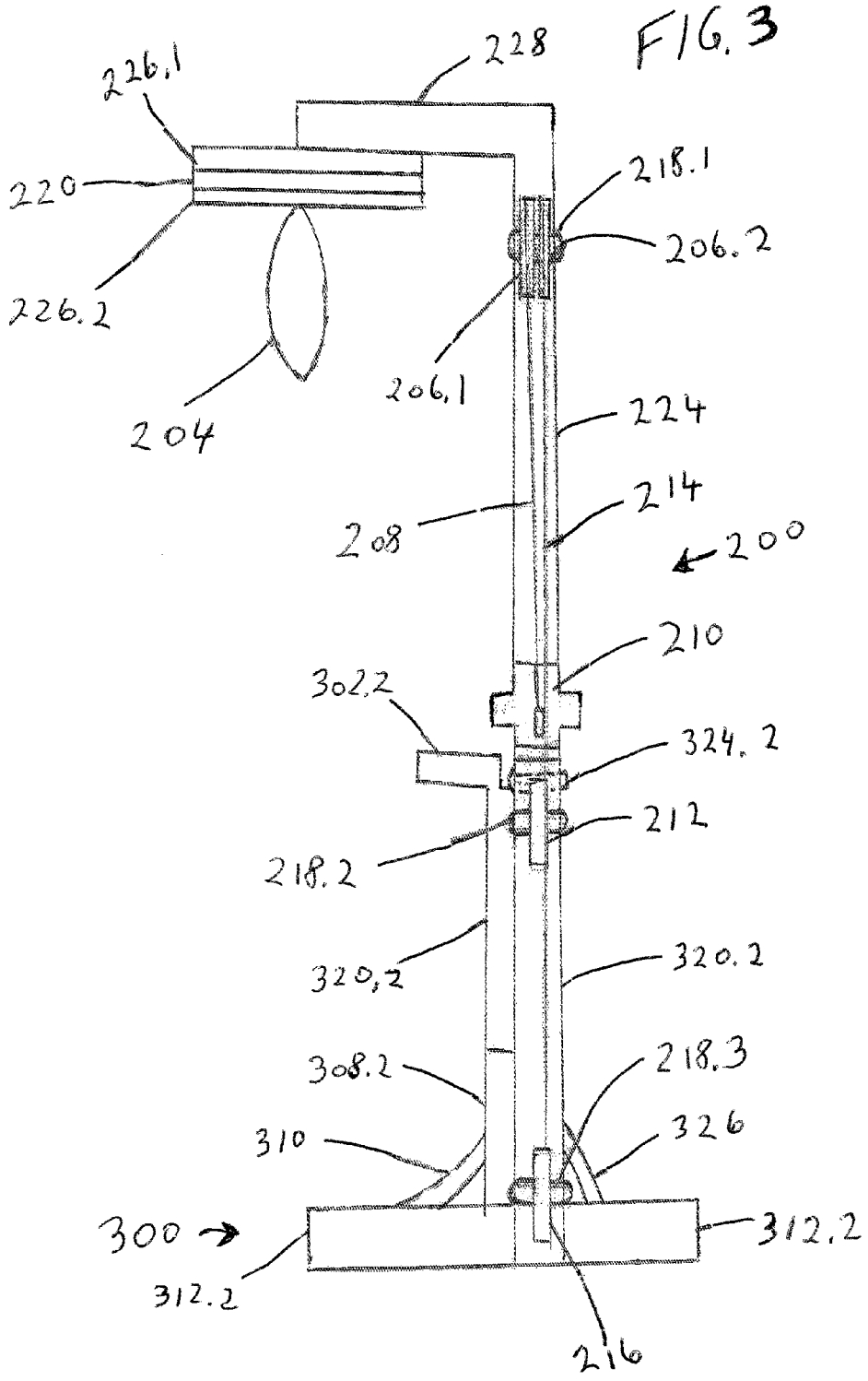
FIG. 3 is a side view of a second tower of the apparatus according to one embodiment of the invention.
Figure 4:
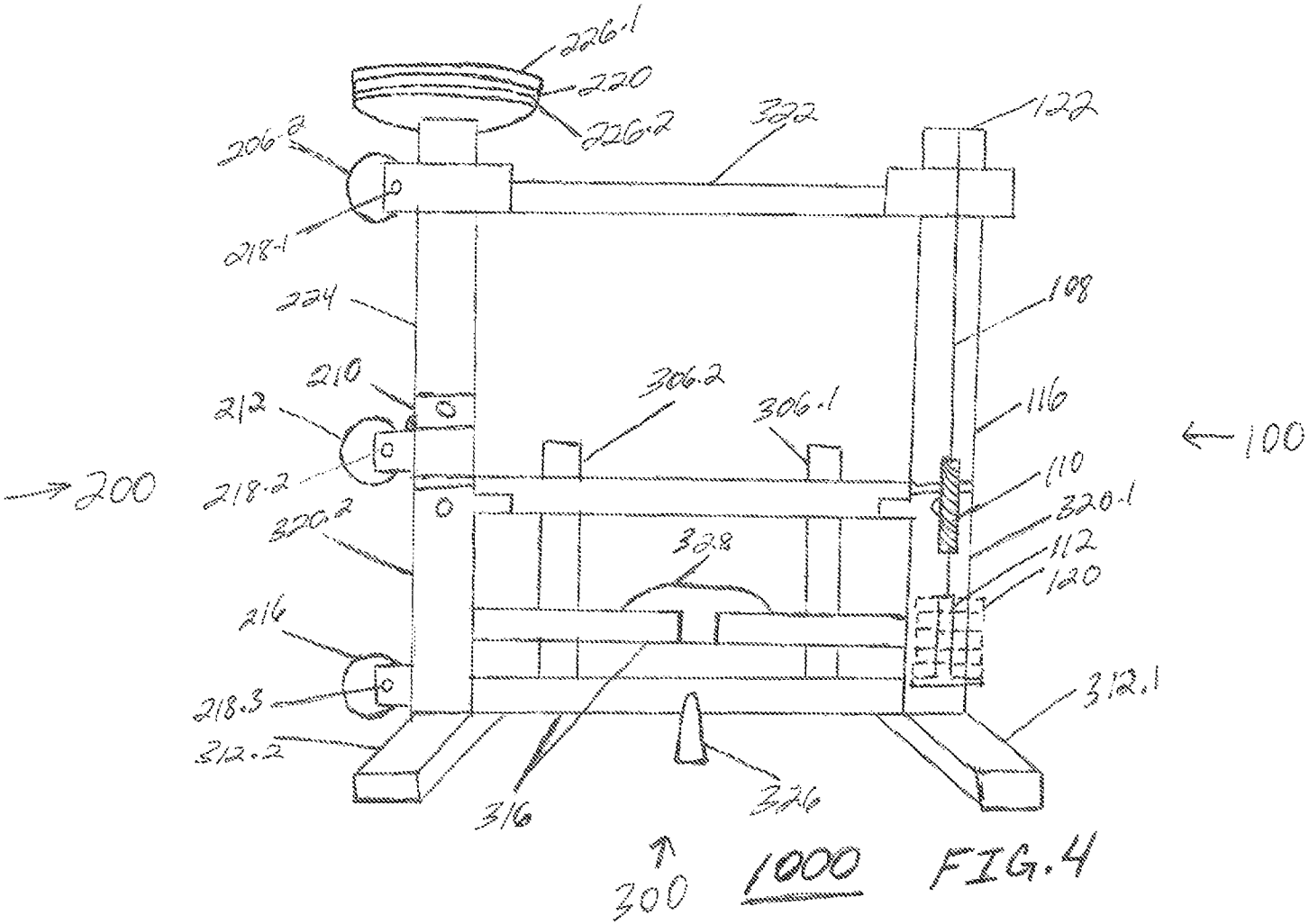
FIG. 4 is a rear view of the apparatus according to one embodiment of the invention.

For example, referring to FIG. 3, the second tower 200 is a 6'×2 inch diameter, circular, steel tube that extends horizontally from the receiving post 320.2 of the device. In this example, an L-shaped 2 inch, square, steel bar attaches perpendicular to the top of the second tower 200 and extends 2.5 feet from the front of the device. This allows for the attachment of a speed bag platform 226.1 and 226.2. The speed bag platform attaches to tower 2 via 4 2×6 inch bolts. The platform consists of 2×1 inch thick, circular, 18-inch diameter boards 226.1 and 226.2. In this example, the boards have rubber underlay 220 between them to soundproof and absorb the high volume, repetitious impact/vibrations of the speed bag as it is hit. In a further example, the speed bag platform has three, 5 lbs. weights placed at the top to prevent the upward movement of the speed bag platform as it is hit. The speed bag 204 is attached to the platform by a general speed bag, ball-bearing swivel. In this example a large size, leather, speed bag is used, but any size speed bag made of any material may be used without departing from the scope and spirit of the invention.

In another example, three pulleys attach to tower 2. In this example, referring to FIG. 3, the top pulley consists of dual pulley wheels using 2×4 inch diameter plastic pulley wheels 206.1 and 206.2. In a further example, the pulley wheels are joined together by a 2 inch×6 inch bolt between 2×12"×4" metal slats extending from the top of tower 2 to hold the wheels in place 218.1 and 218.2 and 218.3. The wheels are able to turn independently of each other without friction due to the use of silicone grease for lubrication of the wheels. In a further example, 3 pulley wheels may be placed side by side, allowing for 3 workout attachments. However, varying amounts of pulley wheels may be combined without departing from the scope and spirit of the invention, as this is not an exhaustive list of the amount of pulley wheels or workout attachments that may be used.

Further, one cable wire passes over the top of each pulley, as shown in 206.1 and 206.2. Cable 1 (3 ft length) 208, after passing over the first top pulley wheel 206.1, attaches to a vertical triceps attachment. Cable 2 (7 ft length) 214, passes over the top of the first pulley wheel 206.2, extends down and under the third pulley 212, a single 4" diameter pulley wheel located in the middle of tower 200 and connects to a vertical curl/row bar attachment. The fourth pulley wheel 216 attaches via 2× 12"×4" metal slats extending from the bottom of the second tower 200 to hold the wheel in place and is held in place by a 2 inch×6 inch bolt. In another example, pulley 3 may be attached at any point on tower 2 to allow for varying degrees, types, and angles of workouts. In this example, the distal ends of each cable wire attach to the center weight plate holder that via a carabiner hook. In this example, a sliding Olympic weight plate holder 210 with 2× 2"×6" horizontal posts that allow for varying Olympic sized weight plates to be held in place for using the curl/row, or triceps workout attachments, is attached to the second tower 200. However, varying types of shapes and weights may be used without departing from the spirit and scope of the invention. General weight clamps may used to keep the weight plates in place and prevent them from sliding or moving during use.

Further, the exercise apparatus 1000, includes a flip down, t-shaped bar 310 that extends 8 inches from the bottom support 316 of the apparatus 1000 at its midline to allow for floor-lying lower and upper abdominal workouts. Additionally an 8 inch post 326 extends from bottom support of the apparatus 1000, opposite the t-bar 310 at its midline to allow for the securing of undulating ropes, an agility ladder, or other workout equipment that requires securing with a post.

The exercise apparatus 1000 allows a user to implement the following workout regimen; 5 mins on the punching bag, 1 min reverse push ups, 1 min incline pushups, 1 min of dips, 1 min of knee/leg raises on dip bars, 1 minute speed bag, 1 min tricep extentions, 1 min curls, 1 min rows, 1 min crunches on the t-bar 310, and 1 min battling ropes secured to post 326.

The foregoing description of the invention has been presented for purposes of illustration and description and is not intended to be exhaustive or to limit the invention to the precise form disclosed, and obviously many modifications and variations are possible in light of the above teaching. They simulate a user facing the apparatus and various parts are numbered. The basic concept is that the user is able to use the apparatus and obtain an efficient, total body workout, by circuit training with the apparatus.

What is claimed is:

1. An exercise apparatus comprising:

a base, said base comprising two receiving posts, said two receiving posts comprising a tower at each distal end connected by a middle section further comprising steel tubes;

dip posts provided in the middle section of the two receiving posts;

a t-bar disposed at a mid-line position of the base;

a first tower comprising a tower bar, said tower bar having a punching bag disposed on one end of the tower bar and having a weight platform, said weight platform comprising a counterweight for the punching bag; and a second tower comprising a speed bag, said second tower further including a curl and triceps extension station.

2. The exercise apparatus of claim 1, wherein the first tower provides a first free standing unit for the punching bag, said first tower comprising a height of approximately six feet.

3. The exercise apparatus of claim 1, wherein the first tower further comprises post middle sections constructed of a member taken from the group consisting of 2 inch steel tubular and circular pipe.

4. The exercise apparatus of claim 3, wherein a top of the post comprises a t-joint.

5. The exercise apparatus of claim 1, wherein the base further comprises a 2.5 foot steel tube extending therefrom.

6. The exercise apparatus of claim 1, wherein the first tower further comprises a hanging unit attaching to a steel tube extending from the first tower.

7. The exercise apparatus of claim 4, wherein the counterweight attaches to a 1 foot steel tube extending from the rear of the t-joint by way of a 5.5 foot chain or steel wire.

8. The exercise apparatus of claim 1, wherein the counterweight comprises varying amounts of weight plates.

9. The exercise apparatus of claim 1, further comprising at least one movable horizontal bars connecting the first tower and the second tower and at least one movable vertical bars disposed across the at least one horizontal bars.

10. The exercise apparatus of claim 1, wherein the second tower includes a second free standing unit for a speed bag platform while at least one pulley cable attachments may be used with the second tower.

11. The exercise apparatus of claim 1, wherein the second tower comprises a second post middle section constructed of a member taken from the group consisting of 2 inch steel tubular and circular pipe.

12. The exercise apparatus of claim 11, wherein a top of the second post comprises an L-joint.

13. The exercise apparatus of claim 1, wherein the base further comprises a 2.5 foot steel tube extending therefrom.

14. The exercise apparatus of claim 13, wherein the speed bag platform unit has a member for attaching to the steel tube extending from the front of the device.

15. The exercise apparatus of claim 14, wherein the speed bag platform comprises a two, 1 inch thick, 18 inch in diameter, and circular wooden boards with a rubber section therebetween for soundproofing an impact on the speed bag.

16. The exercise apparatus of claim 1, further comprising three pulley wheels attached to the second post of the second tower.

17. The exercise apparatus of claim 1, wherein the second tower further comprises a top pulley wheel and dual pulley wheels, wherein the dual pulley wheels turn independently of each other.

18. The exercise apparatus of claim 17, wherein the second tower further comprises a variable weight plate holder attached thereto, said variable weight plate holder being connected to the dual pulley wheels for providing resistance for a user during various workouts.

19. The exercise apparatus of claim 9, wherein one of the one or more movable horizontal bars comprises an adjustable 2-inch bar with 3.5 feet in length.

20. The exercise apparatus of claim 1, wherein the t-bar extends 8 inches from the front of a bottom support of the base at its midline.

* * * * *